United States Patent [19]

Jackson

[11] Patent Number: 4,458,562

[45] Date of Patent: Jul. 10, 1984

[54] ROD WRENCH

[75] Inventor: Paul L. Jackson, Trappers Trail, Ak.

[73] Assignee: Interstate Exploration, Inc., Anchorage, Ak.

[21] Appl. No.: 388,947

[22] Filed: Jun. 16, 1982

[51] Int. Cl.[3] ..... B25B 13/50; A44B 21/00

[52] U.S. Cl. ..... 81/53 A; 81/57.34; 188/67; 166/77.5

[58] Field of Search ..... 81/462, 180 R, 184, 81/53 R, 53 A, 57.34; 166/77.5, 85; 254/30, 31, 106; 24/249 DP, 263 D, 263 DT; 269/152, 243, 234, 246, 249; 173/164; 188/67

[56] References Cited

U.S. PATENT DOCUMENTS 2,700,201 1/1955 Bannister ..... 254/30 X 3,403,901 10/1968 Servadio ..... 269/243

3,739,434 6/1973 Wheeler ..... 166/77.5 X

*Primary Examiner*—Frederick R. Schmidt

*Assistant Examiner*—Debra S. Meislin

*Attorney, Agent, or Firm*—Roland H. Shubert

[57] ABSTRACT

A rod wrench is provided for use with hollow stem auger drills of the type wherein auger sections are connected through a key system and secured together with a fastener. The wrench comprises a body portion which seats on and connects to the top of an auger section, a slip jaw riding in an inclined jaw guide and extending through the wrench body wall, and a pair of pipe gripping jaws at the top of the wrench body. One of those jaws is fixed to the wrench body while the other is relatively movable so as to releasably grip a drill rod passing therebetween.

9 Claims, 3 Drawing Figures

ROD WRENCH

BACKGROUND OF THE INVENTION

This invention relates generally to a wrench adapted for use in connecting and disconnecting rod joints of a hollow stem auger drill.

More particularly, this invention, relates to a wrench adapted to hold a drill rod in place within a hollow stem auger and prevent the rod from turning while tripping rod into or out of the auger.

The drills with which the wrench of this invention is used are of the type known generally as hollow stem auger drills such as those manufactured by C.M.E., Acker and Mobile Drilling Company. Such drills are conventionally used to obtain soil or core samples from exploratory bore holes.

The drill string itself comprises primary sections of tubular pipe having helical auger flights on the external surface and having a bit disposed on the lower end of the bottommost section. Adjacent sections are coupled together by means of mating keys and key ways, which transmit rotary motion, and are secured longitudinally by means of a bolt or stud. A secondary drill string comprising sectional rods terminating in a bit or sample retrieving device, typically a core bit and core barrel, is disposed within the hollow stem auger. A surface rig is arranged to rotate either or both the primary and secondary drill strings and to hoist either or both out of the hole. Both the surface rig and the primary and secondary drill strings are, as noted before, conventional in the art.

Retrieval of a sample obtained by operation of the secondary drill string is accomplished by hoisting, or tripping, the drill rods out of the hole. During the procedure, the primary string or hollow stem auger, remains in the hole. Tripping secondary drill rods out of the hole requires hoisting the drill string a section at a time, disconnecting or breaking each rod joint and stacking the rod sections until the sample carrier reaches the surface. It is to be noted that rod sections of the secondary drill string are conventionally connected by means of threaded joints.

It is conventional practice in tripping the drill string out of the hollow stem auger to first hoist the string to a level whereat a rod joint is disposed above the top of the uppermost auger section. A pair of slip jaws or pipe vice anchored on the auger section top are then placed to secure the drill string against vertical movement. A pair of pipe wrenches, one above the rod joint and the other below it, are then used to break the rod joint and disconnect the top rod section from the remainder of the string. The string is then again hoisted to expose the next rod joint and the procedure is repeated until the entire string is recovered from the hole. A reverse of this procedure is employed to replace the drill string in the hole and continue drilling.

As may be appreciated, the present procedure requires use of three separate tools; the slip jaws and two pipe wrenches, and requires two men for operation of the pipe wrenches to make or break rod joints. Most rigs of this sort operate with a two man crew, the driller and his helper. Thus, while the driller is engaged with operation of a wrench, he necessarily is removed, from the controls of the drill rig.

SUMMARY OF THE INVENTION

A drill rod wrench is provided to hold the drill rod in place and to prevent it from turning while the drill string is being removed from or replaced in a hollow stem auger of the type having sections connected through a key system and secured by a bolt or stud. The wrench comprises a base seatable on the end of an auger section and connectable thereto and having a sliding jaw which engages the drill rod to prevent vertical motion of the rod relative to the auger. A pair of pipe jaws, one moveable relative to the other, are mounted on the wrench body and are adapted to engage the drill rod and prevent it from turning. The wrench body and base are arranged with a vertically extending slot through which the drill rod may pass.

Hence, it is an object of this invention to provide a drill rod wrench for use with hollow stem auger drills.

It is another object of this invention to provide a wrench adapted to seat and lock upon the end of an auger section and to axially and rotationally secure a drill rod string within the auger.

Yet another object of this invention is to provide a drill rod wrench which allows a single operator to make or break a rod joint.

DESCRIPTION OF PREFERRED EMBODIMENTS

Figure 1:
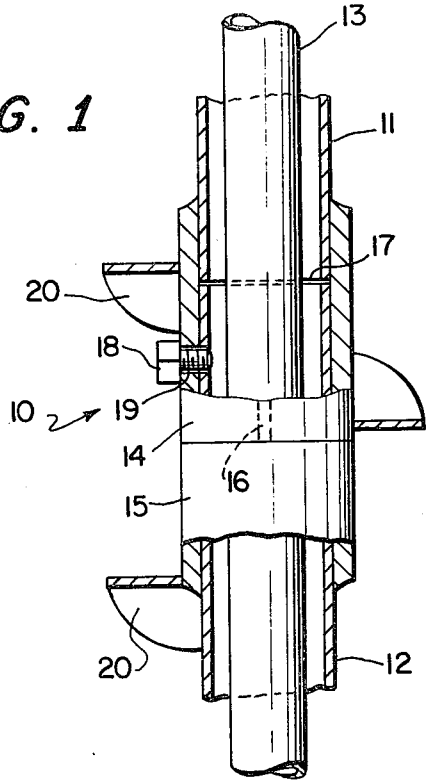
FIG. 1 is a partial sectional view of a portion of hollow stem auger showing the coupling means joining two auger sections and showing the relationship of the drill rod to the auger.

Referring to the drawing where like reference numerals refer to similar parts throughout the figures, there is shown in FIG. 1 a view of two hollow stem auger sections and their juncture means in partial section. The drill rod wrench of this invention is adapted to mount on the top end of the lower auger section and to constrain both rotary and longitudinal movement of a drill rod disposed within the auger.

The auger sections and drill stem assembly are shown generally at 10 and include upper auger stem section 11, lower auger stem section 12 and drill rod 13. Collar 14 is mounted at the lower end of stem 11 while collar 15 is mounted at the upper end of stem 12. One or more keyways 16 are provided at the upper end of stem 12 into which fit mating keys (not shown) disposed on the inner surface of collar 14. The stem ends come into abutting relation within sleeve 14 at 17 so as to form a continuous tubular wall and are held in this abutting relation by means of screw or stud 18 which is threaded into opening 19 of collar 14. The end of stud 18 extends to a point essentially flush with the inner surface of stem 12. During normal drilling operations, drill rod 13 rotates with or independently of the auger sections and may be moved longitudinally independent of the auger. Auger flights 20 are arranged to form a continuous helical path about the outer wall of the auger sections.

Figure 2:
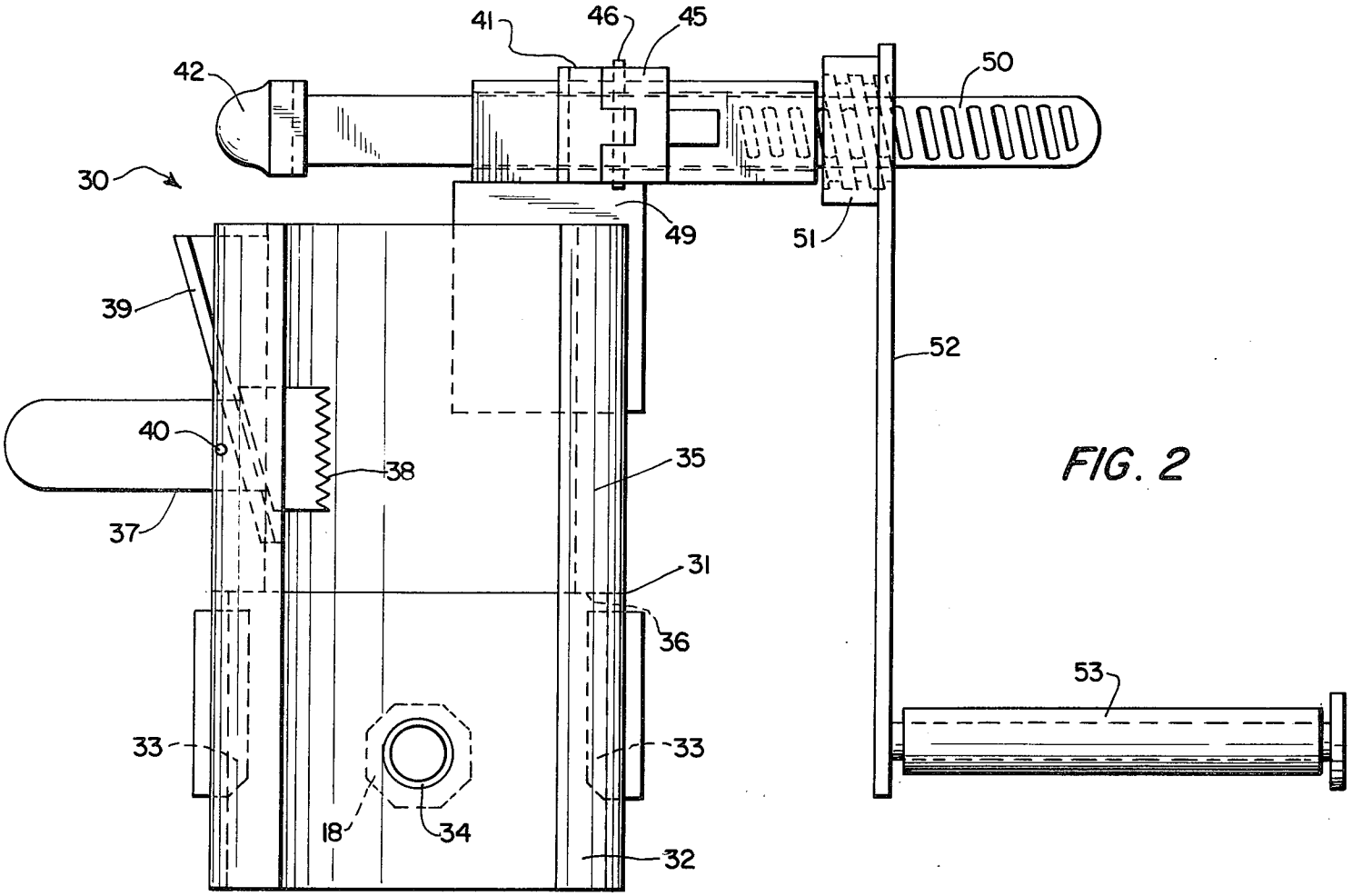
FIG. 2 is front view of the drill rod wrench of this invention.

Referring now to FIG. 2, there is shown at 30 a generalized front view of the rod wrench of this invention. Wrench 30 comprises a body member 31 of arcuate configuration having a diameter sized to matingly fit atop an auger section such as that one illustrated in FIG.

1. Body member 31 includes a lower body section 32 having one or more keys 33 adapted to mate with corresponding key ways 16 provided at the upper end of stem 12 (FIG. 1). There is provided in the back area of body section 32 a tapped hole 34 adapted to receive stud 18, shown in dashed outline, and to secure the wrench body to stem 12.

Upper body section 35 is of increased wall thickness and has a smaller internal diameter than does lower body section 32 so as to provide a ledge 36 fitting in abutting relation with the top of stem 12. Both upper and lower body sections are provided with a vertically extending front opening (better seen in FIG. 3) having a width in excess of the diameter of the drill rod used in association with the auger sections. This opening allows placement of the wrench on an auger section while the drill rod is extended above the auger top.

A sliding jaw 37 having a serrated gripping face 38 is disposed in an inclined jaw guide 39 and extends through the wall of upper body section 35. Jaw guide 39 is arranged so that face 38 engages in gripping contact with a drill rod (not shown) disposed within the auger when the jaw 37 is positioned toward the bottom of the guide and is free of engagement with the drill rod when positioned toward the top of the guide. When in gripping contact with a drill rod, jaw 37 prevents downward vertical movement of the drill rod. Retaining means 40, which may be a pin placed transversely through the jaw body, prevents the jaw from slipping out of the jaw guide. It is preferred that the body part of jaw 37 be extended as shown in the drawing to form a handle allowing a workman to hold the jaw out of contact with the drill rod during vertical movement thereof as in lowering drill rod into the auger.

Figure 3:
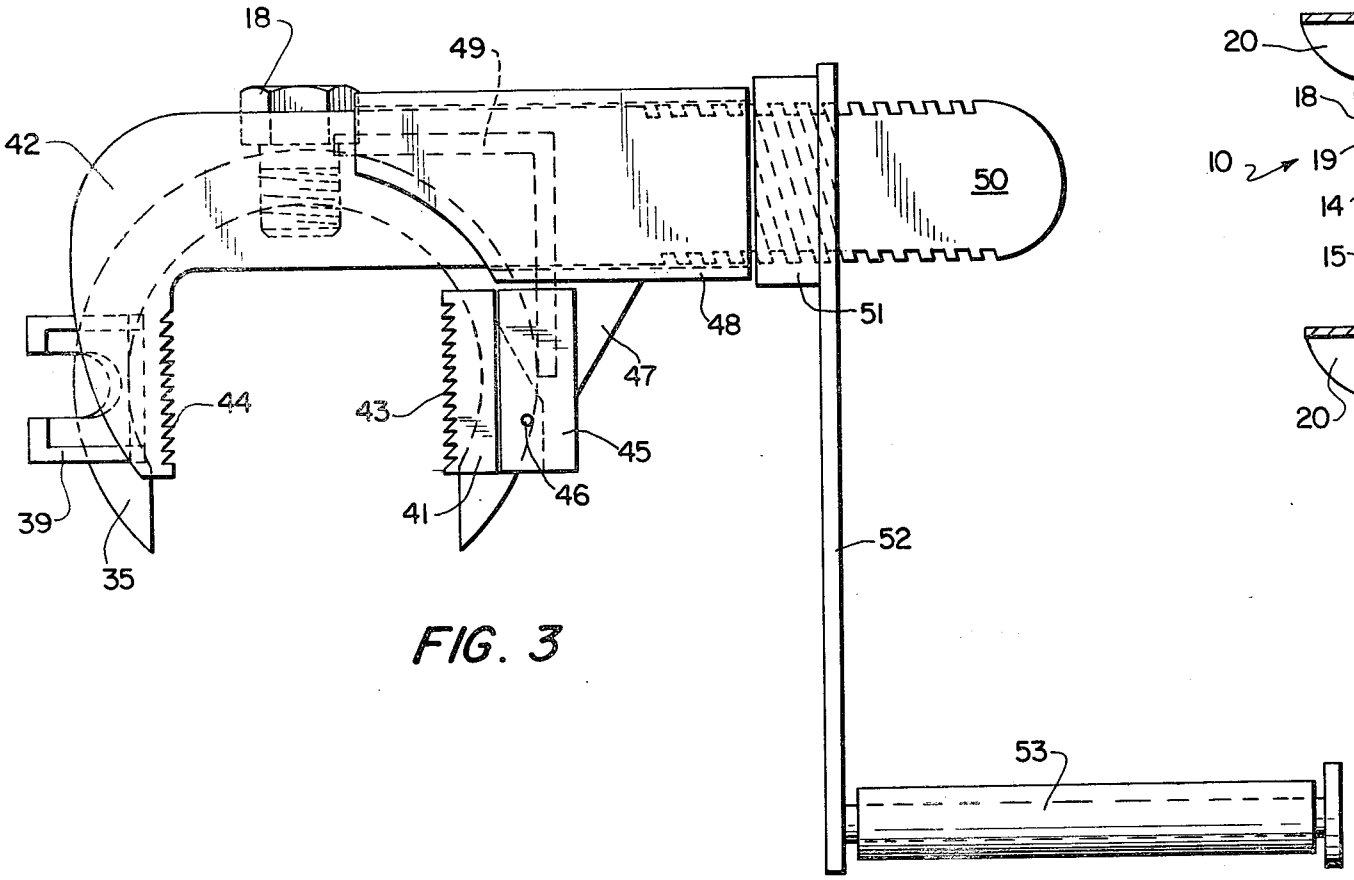
FIG. 3 is a plan view of the drill rod wrench.

Referring now to FIG. 3 as well as to FIG. 2, there is mounted at the top of upper body section 35 a pair of wrench jaws; a fixed heel jaw 41 and a movable hook jaw 42. Both jaws are provided with serrated faces, 43 and 44 respectively, adapted to grip a rod and prevent its rotation. Heel jaw 41 is rigidly mounted to body section 35 through heel holder means 45 to which the heel jaw may be secured by pin means 46. Heel brace 47 provides additional support between the jaw and the wrench body. Hook jaw 42 slides within and is supported by jaw guide 48 which may form an integral unit with heel holder 45. Guide 48 is attached, as through a welded bracket 49, to the wrench body.

Hook jaw 42 is attached to a threaded shank 50 having a configuration typical of the hook jaw of an ordinary pipe wrench. A hook jaw tightening nut 51 operates on shank 50 in an abutting relation to the base of jaw guide 48. In a preferred embodiment, tightening nut 51 is attached to a crank-type handle 52 having a rotatable handle grip 53.

In use, the wrench is first seated on the top of the auger by sliding the keys 33 in the wrench body into the key ways 16 of the auger. It is then secured to the auger by means of attachment stud 18. As drill rod is hoisted out of the auger, sliding jaw 37 moves upward allowing the rod to pass. A rod joint to be broken or taken apart is moved to a point a few inches above the wrench. The rod is then allowed to move downward which seats the sliding jaw 37 on the rod and prevents further downward movement of the rod.

The drill rod is then secured against rotation by tightening the hook jaw to lock the drill rod between the hook and heel jaws at a point just below a rod joint. A second conventional wrench is then applied to the rod section above the joint to break the joint and separate the upper rod section from the remainder of the string. To release the rod from the wrench, the wrench handle is backed off a half turn or so.

Drill rod can be lowered into the auger with the wrench in place by holding the slip jaw at the top of the jaw guide 39. Downward movement of the drill rod may be stopped at any point merely by releasing the slip jaw and allowing it to seat against the rod. The wrench can be removed from the auger at any time by unscrewing attachment stud 18, lifting the wrench out of the key ways and passing the drill rod through the slot in the front of the wrench.

As may now be appreciated, use of the wrench of this invention enables the drill helper to accomplish his duties with a minimum of effort, saves time, and eliminates the need for two men or a "back-up" wrench to take the drill rods apart or put them together. It also enhances the safety of the drilling operation as it allows the driller to remain at the controls of the drilling rig rather than assisting the drill helper while tripping rod out of or into the auger.

It will be apparent from the disclosure of preferred embodiments that certain modifications may be made to the wrench without departing from the spirit and scope of the invention.

I claim:

1. A wrench for loosening and tightening drill rod joints of a hollow stem auger drill of the type wherein adjacent auger sections are connected through a key system and secured together with a fastener; comprising a wrench body of generally arcuate configuration adapted to seat upon the end of an auger section;

means to lockingly secure said wrench body to said auger section end, said means including at least one key adapted to mate with a key way in said auger section end;

a slip jaw movable along an inclined jaw guide and extending through the wall of said wrench body, said slip jaw and said jaw guide arranged so that the face of said slip jaw engages in gripping contact with a drill rod disposed within said auger when said slip jaw is positioned toward the bottom of said guide and is free of engagement with the drill rod when positioned toward the top of said guide;

a pair of pipe jaws positioned at the top of said wrench body, one of said jaws fixed to the wrench body and the other of said jaws movable relative to the first, said jaws adapted to close upon and grip a drill rod disposed within said auger; and means to move said pipe jaws one relative to the other.

2. The wrench of claim 1 wherein said wrench body includes a vertically extending, slot-like opening having a width greater than the diameter of a drill rod disposed within said auger.

3. The wrench of claim 1 including a stud passing through said wrench body and engaging said auger section end.

4. The wrench of claim 1 wherein the body of said slip jaw is extended to form a handle.

5. The wrench of claim 1 wherein the movable one of said pipe jaws is attached to a threaded shank.

6. The wrench of claim 5 wherein the means to move said pipe jaws one relative to the other comprises a jaw tightening nut operating on said threaded shank.

7. The wrench of claim 6 wherein said jaw tightening nut is attached to a crank handle.

8. The wrench of claim 1 wherein the face of said slip jaw is serrated transversely to the axis of a drill rod disposed within said auger.

9. The wrench of claim 1 wherein an upper wall portion of said wrench body is of greater thickness but of the same external diameter as a lower wall portion of said wrench body to form an internal ledge seatable on the top of said auger section.

* * * * *